US005505463A

United States Patent [19]

Hirose et al.

[11] Patent Number: 5,505,463

[45] Date of Patent: Apr. 9, 1996

[54] GAME TOY

[75] Inventors: Tomiyuki Hirose; Asayoshi Asami, both of Tokyo, Japan

[73] Assignee: Sente Creations Co., Ltd., Tokyo, Japan

[21] Appl. No.: 320,649

[22] Filed: Oct. 11, 1994

[30] Foreign Application Priority Data

Feb. 1, 1993 [JP] Japan ..... 5-034018

[51] Int. Cl.[6] ..... A63F 9/00

[52] U.S. Cl. ..... 273/445; 273/393; 472/7

[58] Field of Search ..... 273/445, 446, 273/391–393; 472/7–11

[56] References Cited

U.S. PATENT DOCUMENTS

| | | | |
|---|---|---|---|
| 2,130,289 | 9/1938 | Phelps | 273/393 X |
| 3,272,507 | 9/1966 | Grau | 472/7 |
| 3,594,000 | 7/1971 | Glass et al. | 273/445 X |
| 4,135,715 | 1/1979 | Soulos | 273/446 X |

FOREIGN PATENT DOCUMENTS

| | | | |
|---|---|---|---|
| 1911884 | 9/1970 | Germany | 472/10 |
| 2030049 | 4/1980 | United Kingdom | 273/445 |
| 2089221 | 6/1982 | United Kingdom | 273/446 |

*Primary Examiner*—Paul E. Shapiro
*Attorney, Agent, or Firm*—Waldron & Associates

[57] ABSTRACT

A game toy provides amusement that cannot be obtained with games simulating actual contests, so that players can compete over the number of pieces held by avoiding loss of pieces. The game toy has piece retention means 2*a*, 2*b*, 2*c* and 2*d* for keeping the player's pieces in predetermined positions, a moving object 3 for moving the pieces from the positions when it collides with the pieces, collision prevention means 4*a*, 4*b*, 4*c* and 4*d* being operated by the player to prevent collision between the pieces and the moving object when the moving object approaches the pieces, a support means 5 for supporting the moving object 3 so that it can freely spin vertically, and a drive means for rotating the support means 5 around the vertical axis.

5 Claims, 12 Drawing Sheets

GAME TOY

TECHNICAL FIELD

This invention relates to a game toy with which players compete to see who can avoid collision of a moving object with their piece and hold on their piece.

BACKGROUND ART

There are a wide variety of contests, such as tennis, ping pong, etc., with which points are scored by the opposing player when the moving object, such as a ball, etc., of one player enters the specified region of the other player and the player on whose side the ball has entered cannot stop the moving object, and games that imitate this type of contest have also been presented.

However, conventional games simply imitate actual contests and it cannot be said that they provide amusement different from the actual contest for which points are competed.

Therefore, an object of this invention is to present a game toy which provides amusement that cannot be obtained with games simulating actual contests, because it is structured so that players compete for the number of pieces by avoiding the loss of a piece.

DISCLOSURE OF INVENTION

This invention is characterized by that it has a piece retaining means for holding a player's piece at the desired position, a moving object which moves the piece from the position by colliding with the piece collision retention means which the player operates in order to avoid collision of the moving object with the piece when the moving object is close to the piece, a support means that supports the moving object so that it can freely spin in the vertical direction, and a drive meanes which rotates said support meanes around the vertical axis.

Under the preferred embodiment of the invention, the game toy has a stopper meanes for stopping the moving object so that it is held in a vertical state and a release means with which the player can release the suspension.

It is preferred that the stopper means comprises a movable pin which has an end engage with a concave section or hole in the moving object in order to stop the moving object.

It is also preferred that the moving object has a colliding part that collides with the piece at its front end and a spindle at its back end, with the moving object being supported so that it can freely spin around a fulcrum near the back end.

It is further preferred that the collision prevention means have a lever supported so that it can spin freely up and down and a spring at one end of said lever attached so that it can spin freely at the desired angle with regard to a direction in which the moving object is moving, and the collision prevention meanes is made so that when the player pushes the other end of the lever, the moving object jumps due to the force of the spring.

According to this invention, the moving object moves with rotation of the support mechanism that is rotated and driven by the drive means. When the moving object collides with the piece that is held at a specific position by the piece retention means, the piece is moved and emitted from that position. The player can avoid collision with the moving object by operating the collision prevention means. That is, since the moving object is supported so that it can freely spin a vertical direction by the support means, collision can be prevented by making the moving object jump using the collision prevention means. Thus, a game is played whereby players compete over the numver of pieces that are retained in the end.

Under the preferred embodiment of this invention, the moving object is kept in a vertical state by a stopper means and the game can be started by releasing the stopper using the suspension release means. In this case, when the stopper means is released, the turning force of the support means is applied to the moving object and the moving object falls from its vertical state in the direction in which it can spin. The direction in which the object falls is determined by the position of the moving object in its vertical state and the position at which the support mechanism starts, and is therefore not specific. Consequently, the moving object may fall so that it is on either player's side when the game is started, which makes the game more exiting. Moreover, there is no advantage or disadvantage when the game is started and the game can be started fairly.

Furthermore, under the preferred embodiment of the game toy, the stopper means comprises a movable pin which has an end engage with a concave section or hole in the moving object in order to halt the moving object.

In addition, under the preferred embodiment of the invention, there is a colliding part that collides with piece at the front end and a spindle at the back end of the moving object, with the moving object being supported so that it can freely spin with the area around the back end being the fulcrum, and therefore, when the moving object spins vertically, the colliding part slowly turns (for instance, like a plane in flight). Moreover, it is preferred that the support means has a stopper that holds the moving object so that the colliding part moves almost horizontally when the moving object moves with rotation of the support means.

Furthermore, under the preferred embodiment of the invention, there is a spring attached to a lever so that it can freely spin at the desired angle to the direction in which the moving object is moving and therefore, ease of the game can be adjusted by changing the angle to the direction of movement of the moving object.

BEST MODE FOR CARRYING OUT THE INVENTION

Figure 1:
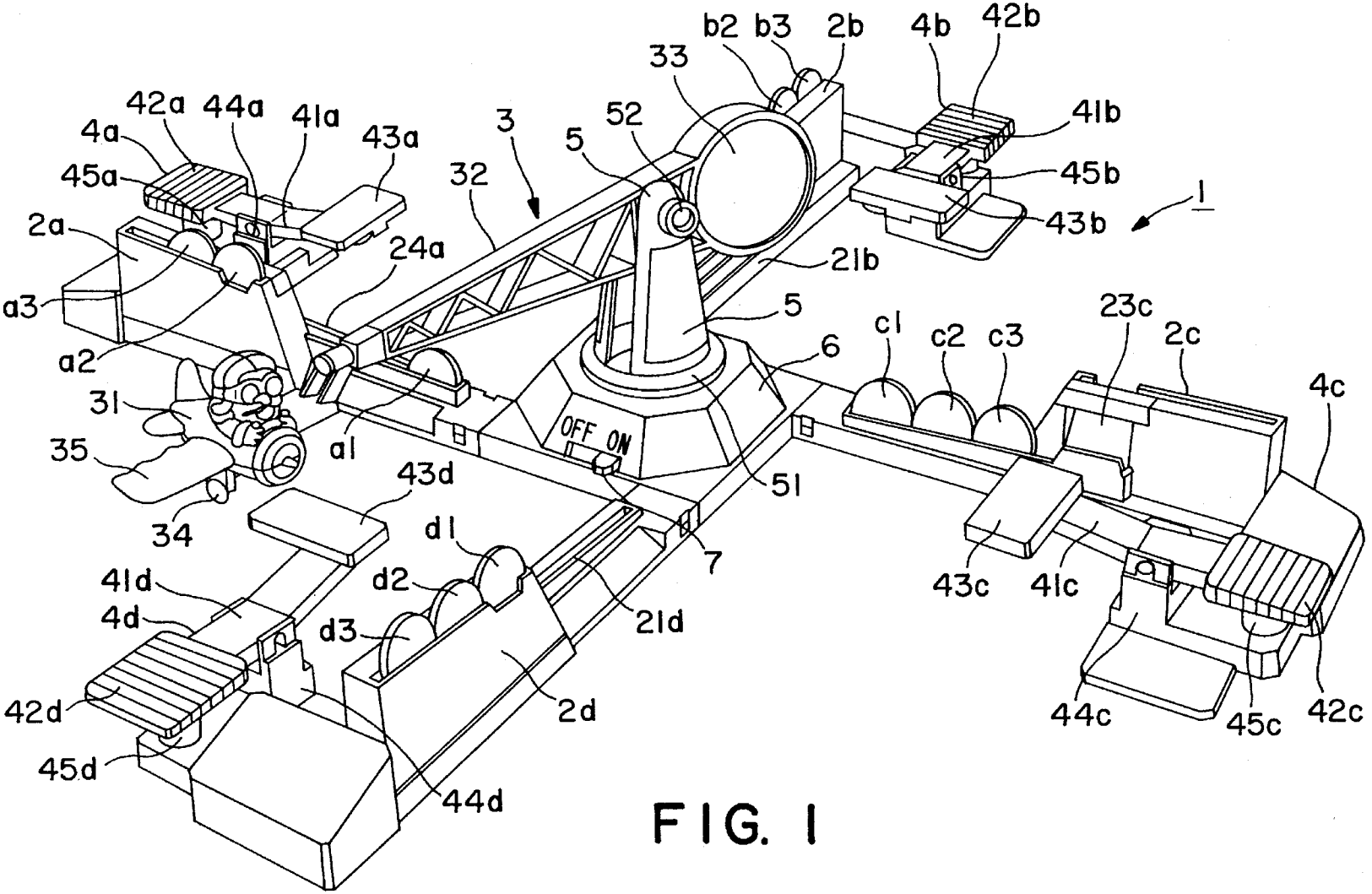
FIG. 1 is an outside view of an example of the game of this invention.

FIG. 1 shows a game toy that can be played by four players as an embodiment of this invention.

A game toy 1 has coins a1, a2, . . . , b1, b2, . . . , c1, c2, . . . and d1, d2, . . . as pieces for each player, coin retainers 2*a*, 2*b*, 2*c* and 2*d* as the piece retaining means that holds a specific number of these coins (three in this example) for each player, an arm 3 as the moving object, spring devices 4*a*, 4*b*, 4*c* and 4*d* as the collision prevention means, a tower 5 as the support means, drive means housing 6 and switch 7.

Figure 2:
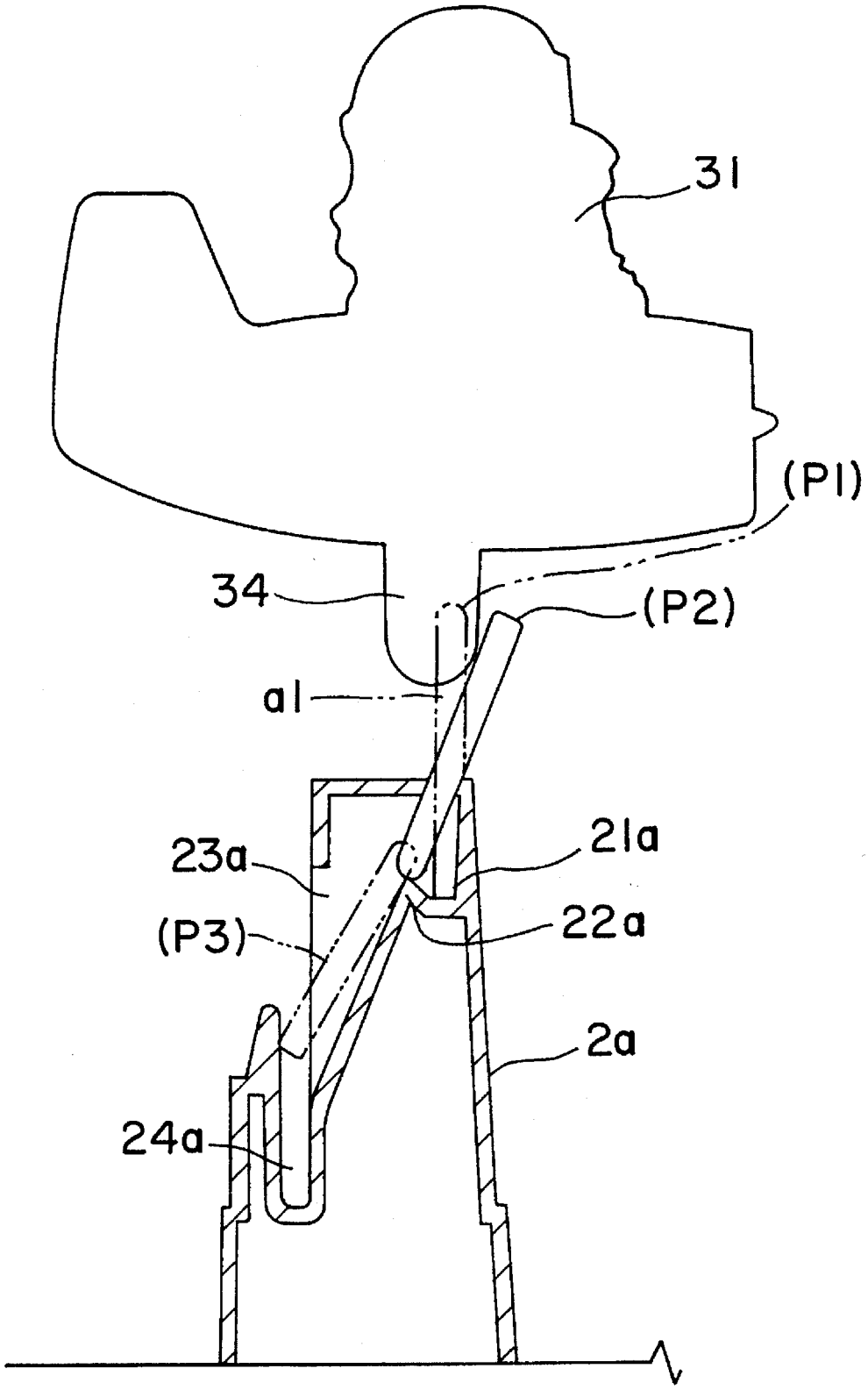
FIG. 2 is a cross section of the coin retainer.

As shown by P1 in FIG. 2, coin retainers 2*a*, 2*b*, 2*c* and 2*d* retains coins at slits 21*a*, 21*b*, 21*c* and 21*d*. When a wheel 34 which protrudes to the base of a toy airplane 31 discussed later, collides with a coin a1 held in this position, the coin a1 is inclined as shown by P2, climbs over protruding part 22*a*, falls to P3 and is emitted to a slit 24*a* from an opening 23*a*. The slit 24*a* is inclined down to the center of the game toy 1 and therefore, coin a1 moves to the front end of the slit 24*a* and stops, as shown in FIG. 1. A slit 21*a* is similarly inclined and therefore, when the coin a1 is emitted, the next coin a2 moves to a position P1.

Thus, coins supported at each coin retainer 2*a*, 2*b*, 2*c* and 2*d* move to the position P1 as coins are emitted when they collide with wheels 34 and therefore, the number of coins held by the coin retainers 2*a*, 2*b*, 2*c* and 2*d* decreases with each collision.

The arm 3 includes a frame 32, the simulated airplane 31 as the colliding part supported so that it can freely spin at the end of the frame 32, and a spindle 33 connected to the back end of the frame 32.

The frame 32 is supported so that it can freely spin by an axle 52, which is suspended over the tower 5. Thus, the arm 3 is supported so that it can freely rotate vertically. Furthermore, as will be mentioned later, by rotating the tower 5 around the vertical axial direction, the arm 3 will spin in a horizontal direction.

Figure 3A:
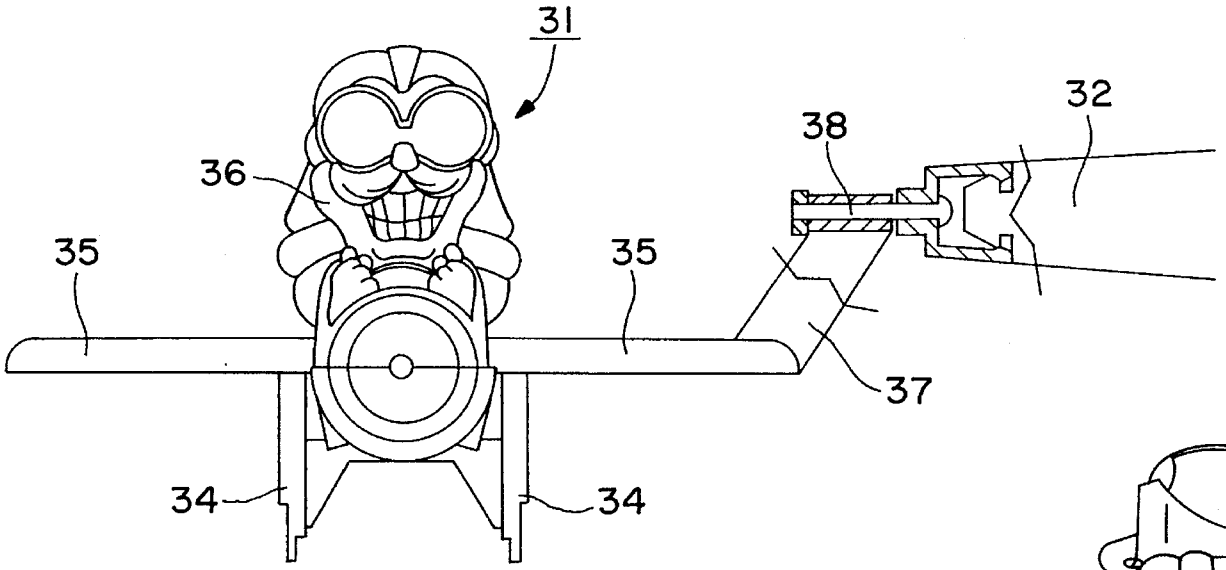
FIG. 3 shows the structure of the simulation airplane.
Figure 3B:
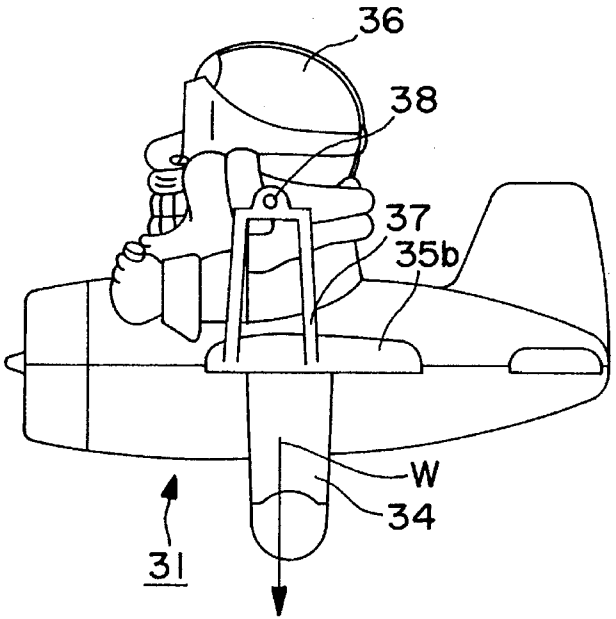

The airplane 31 has a pair of wheels 34, a pair of blades 35, a pilot 36 and a joint 37. The top of the joint 37 and the front end of the frame 32 are joined by a pin 38. Thus, the airplane 31 can make loops with the pin 38 serving as the center of rotation. As shown in FIG. 3(*b*), where the airplane 31 is viewed from the side, a weight is at the base of the airplane 31 seen from the pin 38 and therefore, even if the airplane 31 flies loops, its base is kept on the bottom, as shown in FIG. 3. Thus, the wheels 34 are on the bottom of the airplane 31 when the arm 3 is spinning horizontally and the arm 3 spins so that it collides with the coins held at the position P1 by coin retainers 2*a*, 2*b*, 2*c* and 2*d*.

The tower 5 is attached to the top of the support 51, which will be mentioned later, so that they rotate as one unit. Moreover, a stopper that holds the arm 3 horizontally is used in order to turn the airplane 31, which is at the front end of the arm 3, almost horizontally as the tower 5 rotates.

Furthermore, by using the spindle 33, the arm 3 spins relatively slowly around the axle 52 when the airplane 31 jumps at springs 4*a*, 4*b*, 4*c* and 4*d*, which will be discussed later, so that turning of the airplane 31 is seen. When the arm 3 is spun vertically, the airplane 31 jumps with the spring force of the springs and either falls to the opposite player's side or returns to the player who initiated the jump. In either case, the arm 3 spins horizontally as it jumps and falls and therefore, the player can avoid collision and emission of the coin by making the airplane 31 fly over the coin held at the position P1.

Springs 4*a*, 4*b*, 4*c* and 4*d* have lever 41*a*, 41*b*, 41*c* and 41*d* that are each turned up, buttons 42*a*, 42*b*, 42*c* and 42*d* at one end of each lever, springing parts 43*a*, 43*b*, 43*c* and 43*d* at the other end of each level, and supports 44*a*, 44*b*, 44*c* and 44*d* that support each of the levers so that they can freely spin. Since each support 44*a*, 44*b*, 44*c* and 44*d* is supported so that it is inclined toward each button from the center, each springing part 43*a*, 43*b*, 43*c* and 43*d* is kept at the bottom and each button 42*a*, 42*b*, 42*c* and 42*d* is kept at the top.

Moreover, stoppers 45*a*, 45*b*, 45*c* and 45*d* that keep buttons 42*a*, 42*b*, 42*c* and 42*d* at the downward position are at the top of each stopper in order to prevent each springing part 43*a*, 43*b*, 43*c* and 43*d* from rising the wheels 34 of the airplane 31.

Consequently, when the player pushes buttons 42*a*, 42*b*, 42*c* and 42*d* with springs 4*a*, 4*b*, 4*c* and 4*d*, levers 41*a*, 41*b*, 41*c* and 41*d* rotate, and springing parts 43*a*, 43*b*, 43*c* and 43*d* rise, while buttons 42*a*, 42*b*, 42*c* and 42*d* stop at each stopper 45*a*, 45*b*, 45*c* and 45*d*. When the player releases buttons 42*a*, 42*b*, 42*c* and 42*d*, springs 4*a*, 4*b*, 4*c* and 4*d* return to their original state.

When the airplane 31 approaches coin retainers 2*a*, 2*b*, 2*c* and 2*d*, the player operates springs 4*a*, 4*b*, 4*c* and 4*d* so that springing parts 43*a*, 43*b*, 43*c* and spring against the wheels of the airplane 31 in order to prevent collision of wheels 34 with the coins held at the position P1. Thus, a reduction in the number of coins held by coin retainers 2*a*, 2*b*, 2*c* and 2*d* can be prevented if the player's timing in causing the airplane 31 to jump is good, and a game to compete over the number of coins that are held can be played by several players.

Figure 4:
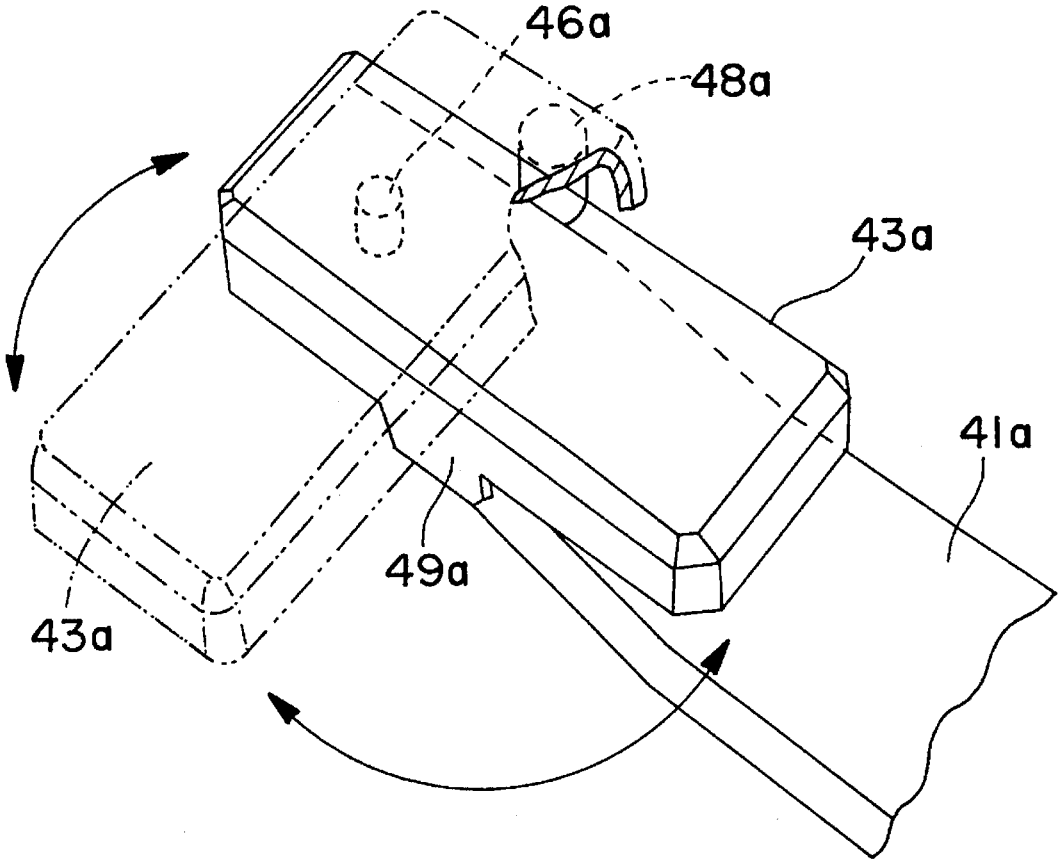
FIG. 4 shows the mechanism of the springing parts.

FIG. 4 shows the structure of a springing part 43*a*. The other springing parts are the same.

The springing part 43*a* is attached to a lever 41*a* by a bearing 46*a* shown by the broken line so that it can freely spin within a range 90° with respect to the direction of movement of the airplane 31. When this springing part 43*a* spins around the bearing 46*a* in a counter-clockwise direction, spinning is controlled by a stopper 49*a* on the side of the springing part 43*a* where the lengthwise direction of the lever 41*a* and the lengthwise direction of the springing part 43*a* are parallel to one another.

On the other hand, when the springing part 43*a* spins around the bearing 46*a* in a clockwise direction, spinning is controlled by a stopper 48*a*, which represented by a cut-out of part of the springing part 43*a*, where the lengthwise direction of the springing part 43*a* is perpendicular to the lengthwise direction of the lever 41*a*. The position of the lever 41*a* and the springing part 43*a* at this time is shown in FIG. 5(*b*).

Figure 5A:
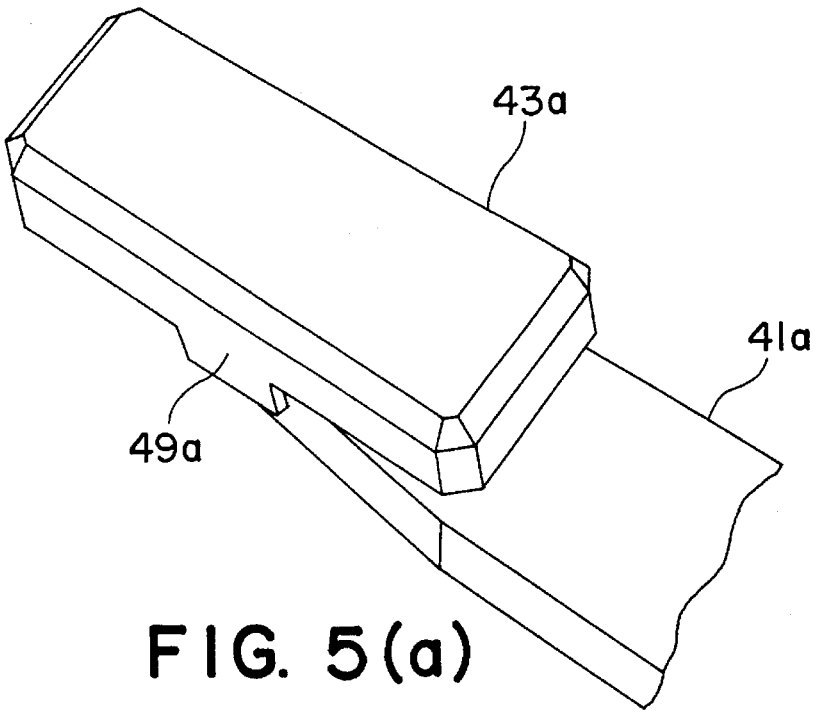
FIG. 5 shows the two positions of the springing parts.
Figure 5B:
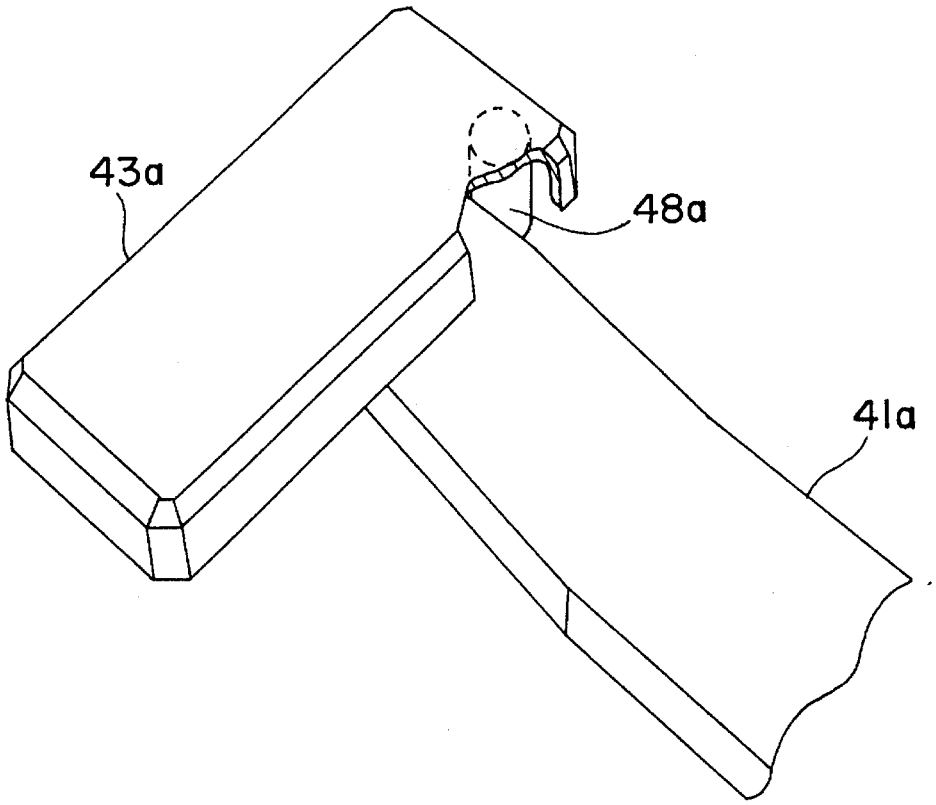

When the springing part 43*a* is designed as shown in FIG. 5(*a*), the width where the springing part 43*a* touches wheels 34 of the airplane 31 is short in the direction of movement of the airplane 31 and therefore, it is relatively difficult for the player to make the airplane 31 jump with good timing. On the other hand, when the springing part 43*a* is designed as shown in FIG. 5(*b*), the width where the springing part 43*a* touches wheels 34 of the airplane 31 is long, and it is relatively easy to make the airplane jump.

Thus, the ease and pleasure of the game can be varied by changing the angle of springing parts 43*a*, 43*b*, 43*c* and 43*d* with respect to the airplane 31. Moreover, the game can also be played by changing the angle of springing parts 43*a*, 43*b*, 43*c* and 43*d* for different players depending on player skill.

Figure 6:
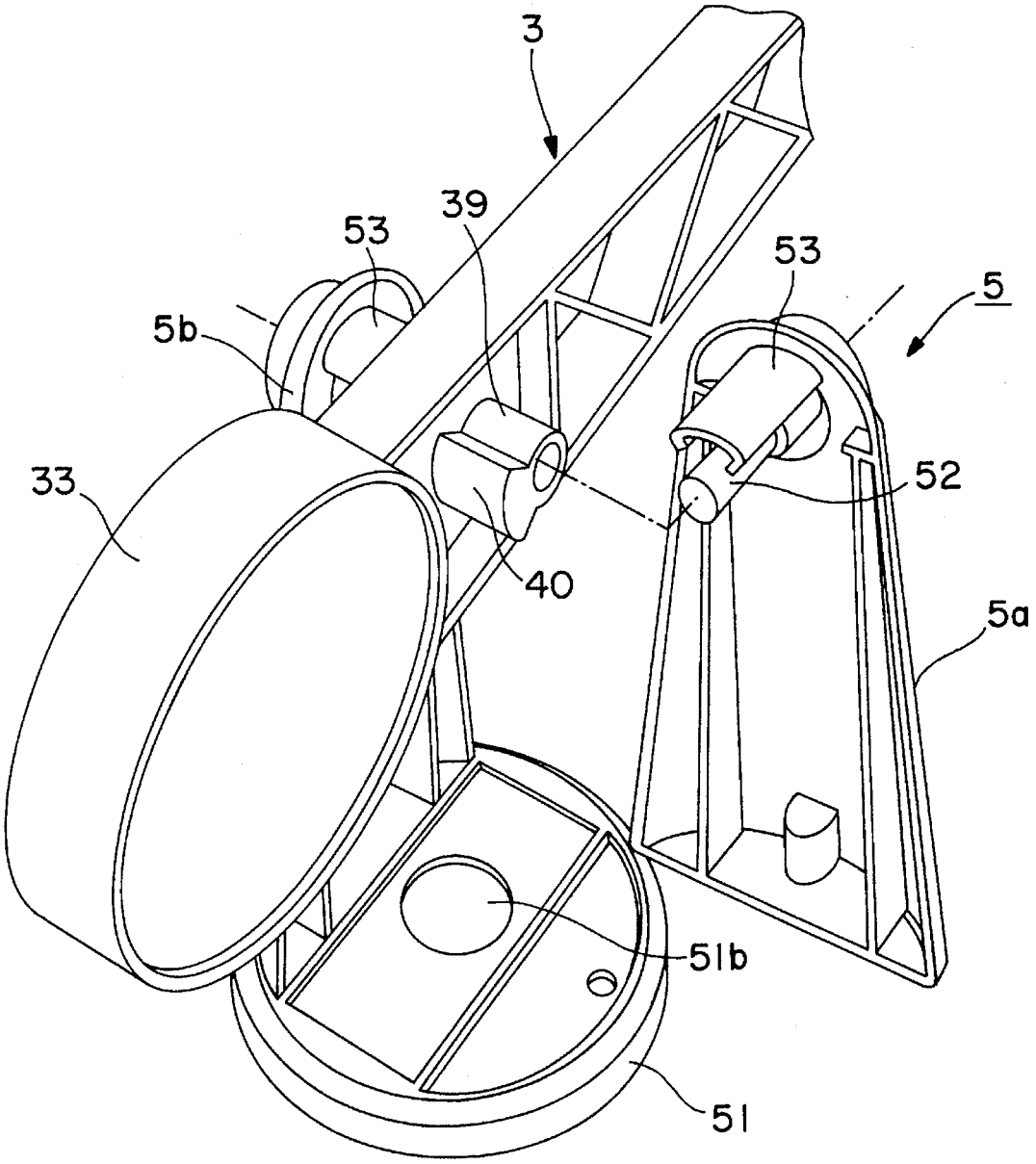
FIG. 6 shows the structure of the tower.

FIG. 6 is a partial view of the inside structure of the tower 5.

The tower 5 is made of a pair of sides 5*a* and 5*b*. Each side is fixed to the support 51 by with machine screws, etc. A pair of axles 52 and a pair of stoppers 53 are set up on the inside of walls 5*a* and 5*b*.

Figure 12B:
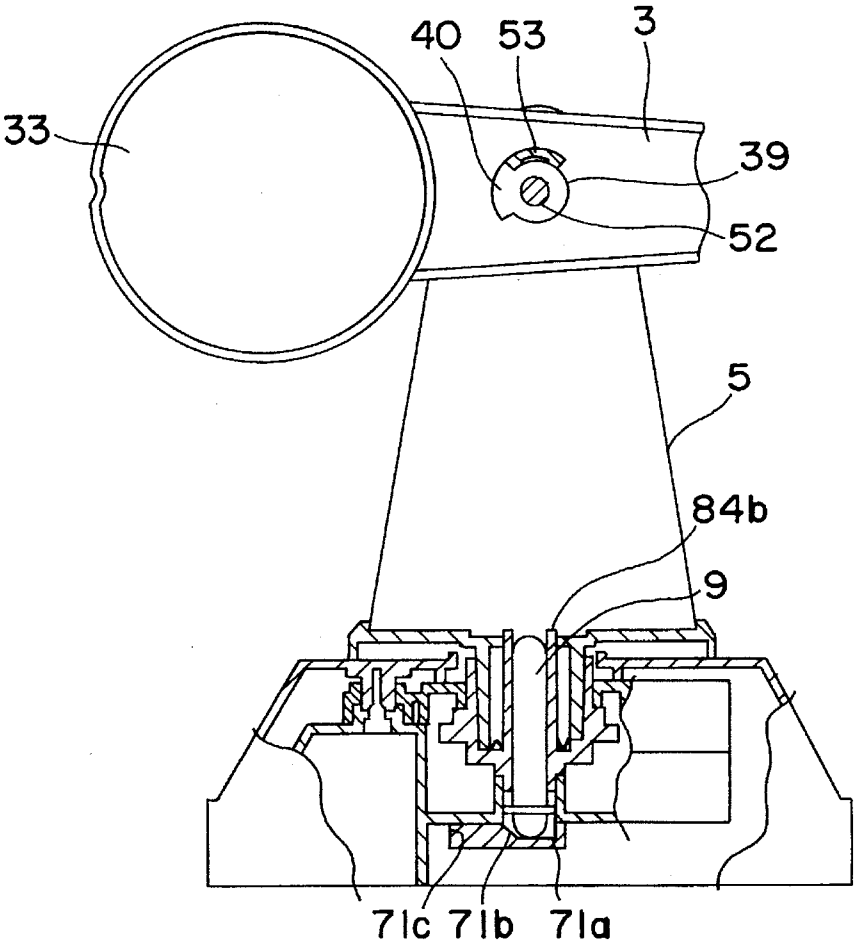
FIG. 12(*a*) shows the state where suspension in FIG. 8 has been released and the arm has started to fall and FIG. 12(*b*) shows the state where the arm is suspended by a stopper.
Figure 12A:
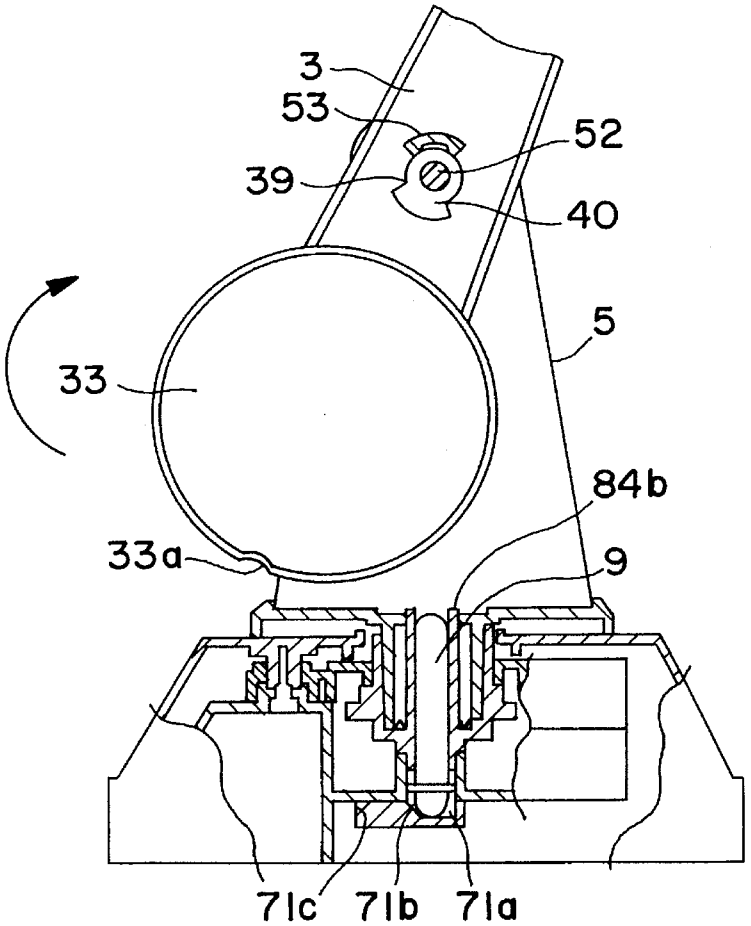

Each axle 52 is inserted into a pair of bearings 39 that are set up on both sides of the arm 3 so that the arm 3 is supported so that it can freely spin in a vertical direction. The range of this spinning can be controlled by making a protrusion 40 in the bearing 39 touch the stopper 53, as shown in FIG. 12 mentioned later.

Figure 7:
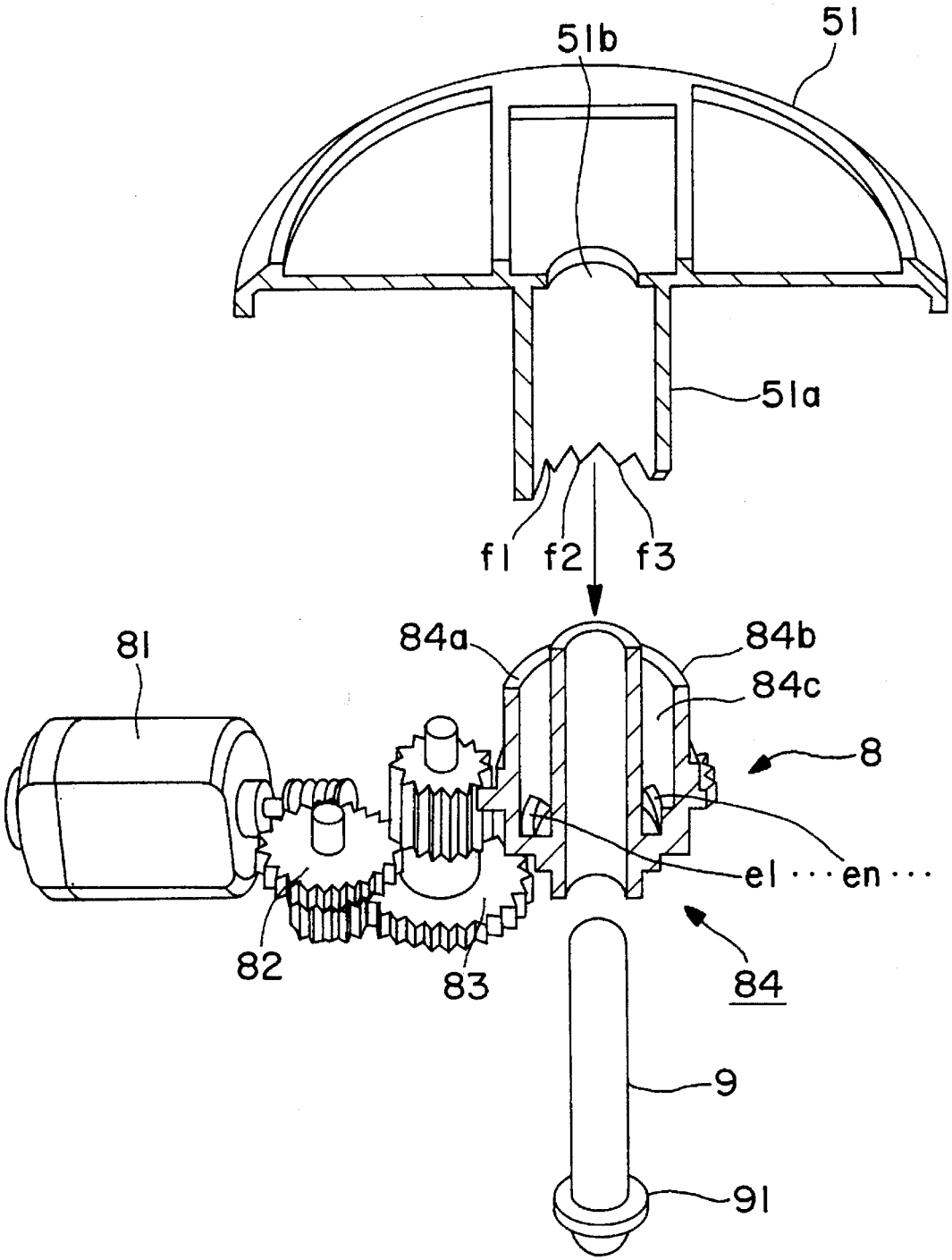
FIG. 7 shows the structure of the driving part.

FIG. 7 shows the structure of the driving part for rotating the tower 5.

A driving part 8 is housed inside the housing 6 shown in FIG. 1 and has reduction gears 82 and 83 and a tube 84 in which teeth that engage with the gear 83 are formed on the outside to form the driving means of this invention. Rotary output of a motor 81 is applied to the tube 84 once speed reduction is performed by reduction gears 82 and 83.

The tube 84 is formed by joining outer tube 84*a* with inner tube 84*b* at the bottom. As a result, space 84*c* is formed. Furthermore, several teeth e1, e2, . . . are made at the base of the space 84*c*. A tube 51*a*, which is formed at the bottom of the support 51 that supports the tower 5 at the top and rotates as one unit with the tower 5, is inserted in this space 84*c*, and the inner tube 84*b* passes through a hole 51*b* at the center of the support 51.

There are several teeth f1, f2, . . . that engage with several teeeth e1, e2, . . . of the tube 84 at the bottom of the tube 51*a* and therefore, the support 51 is rotated by rotation of the tube 84. Consequently, the tower 5 rotates when the motor 81 rotates.

A pin 9 that supports a switch 7, which will be mentioned later, is inserted so that it can freely move inside the inner diameter of the tube 84*b*. The pin 9 is made so that when a stopper 91 touches the bottom end of the inner tube 84*b*, the front end of the pin 9 engage with a concave part 33*a* in the spindle 33, as shown in FIG. 8.

Figure 8:
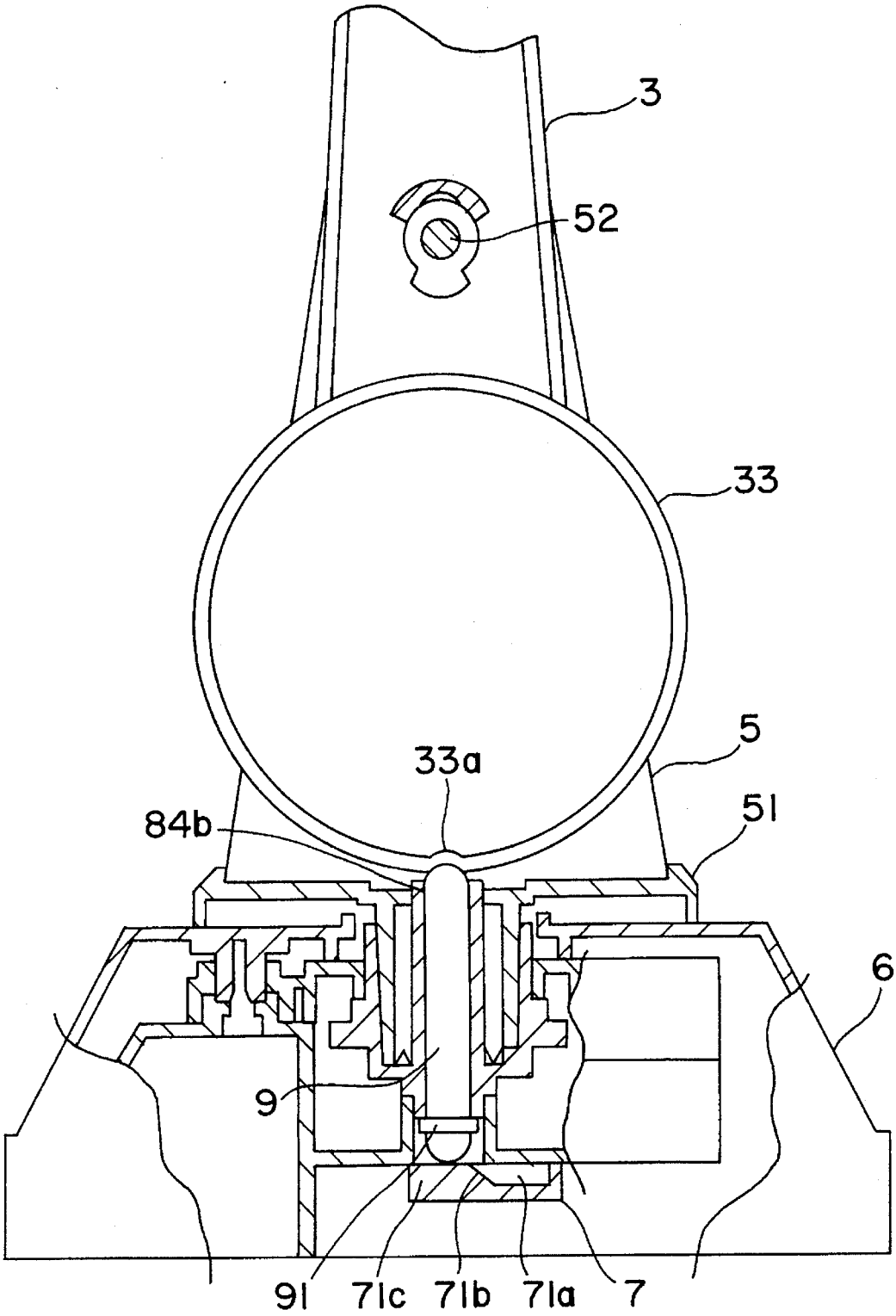
FIG. 8 shows the mechanism by which the pin suspends the arm.
Figure 9:
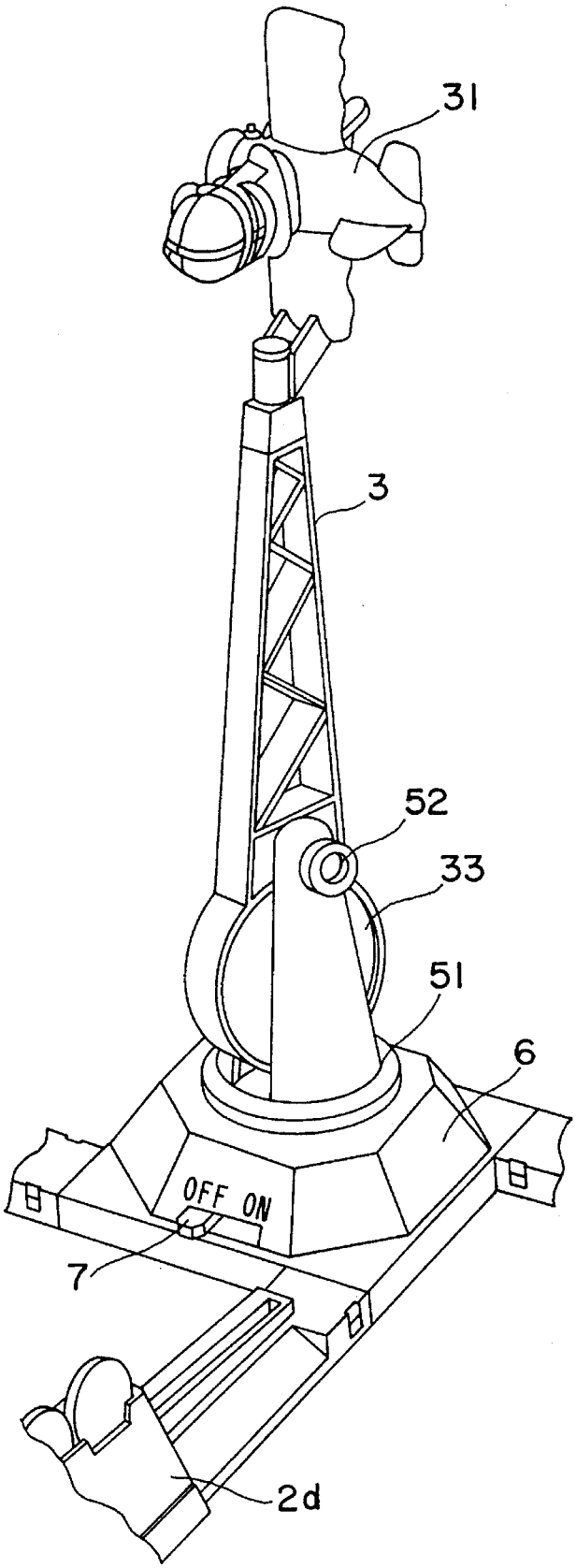
FIG. 9 shows the suspended arm.

Consequently, when the bottom end is stopped with the switch 7 in the OFF position, as shown in FIG. 8, the arm 3 which can freely spin in a vertical direction, is suspended vertically from the pin 9. Thus, the arm 3 is kept on stand-by to start the game, as shown in FIG. 9. In this case, the switch 7 is at the position shown in FIG. 10. As shown in FIG. 1, when the switch 7 is rutned ON under this stand-by condition, the pin 9 drops and suspension of the arm 3 is released.

Figure 10:
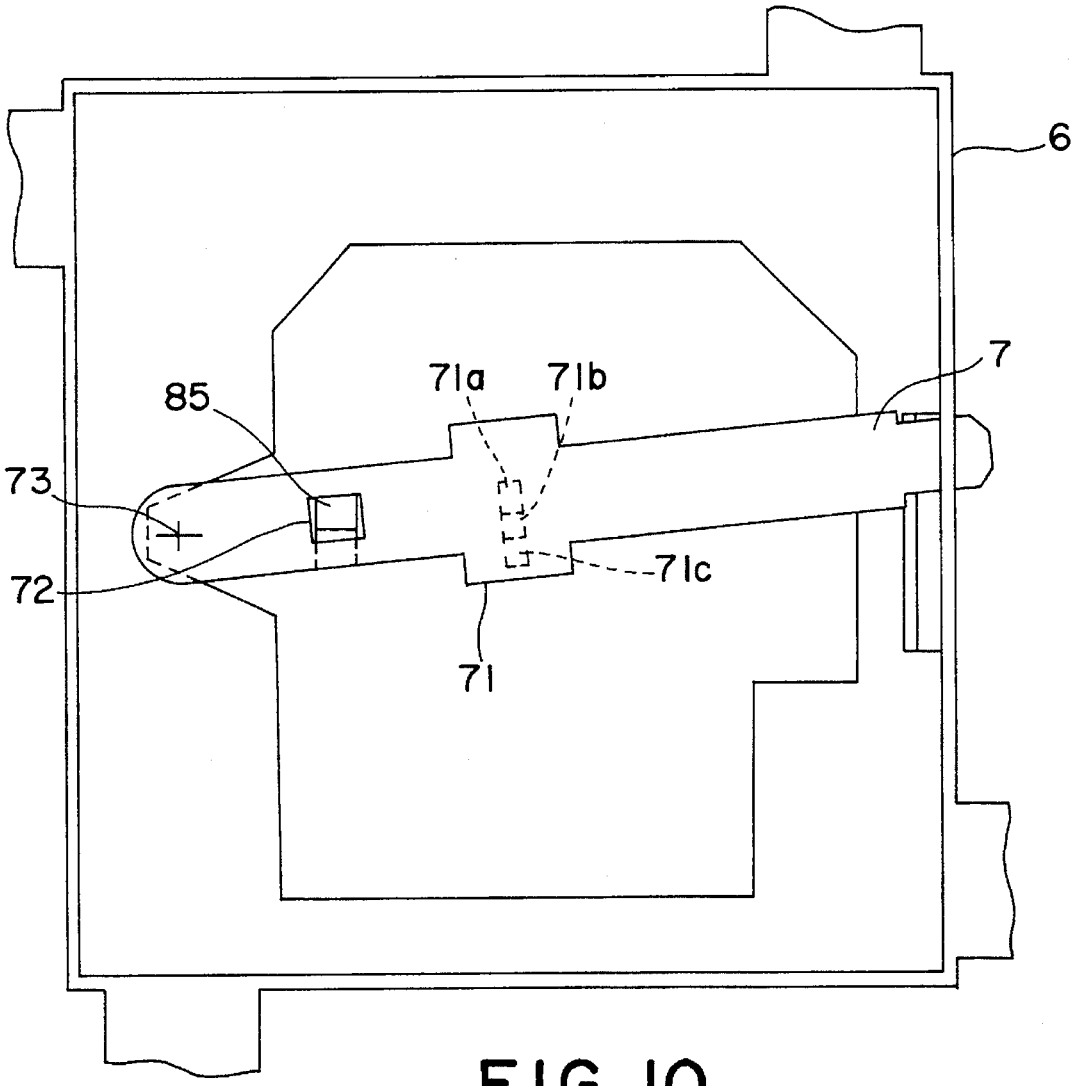
FIG. 10 shows the OFF state of the switch from the bottom of the driving means housing.
Figure 11:
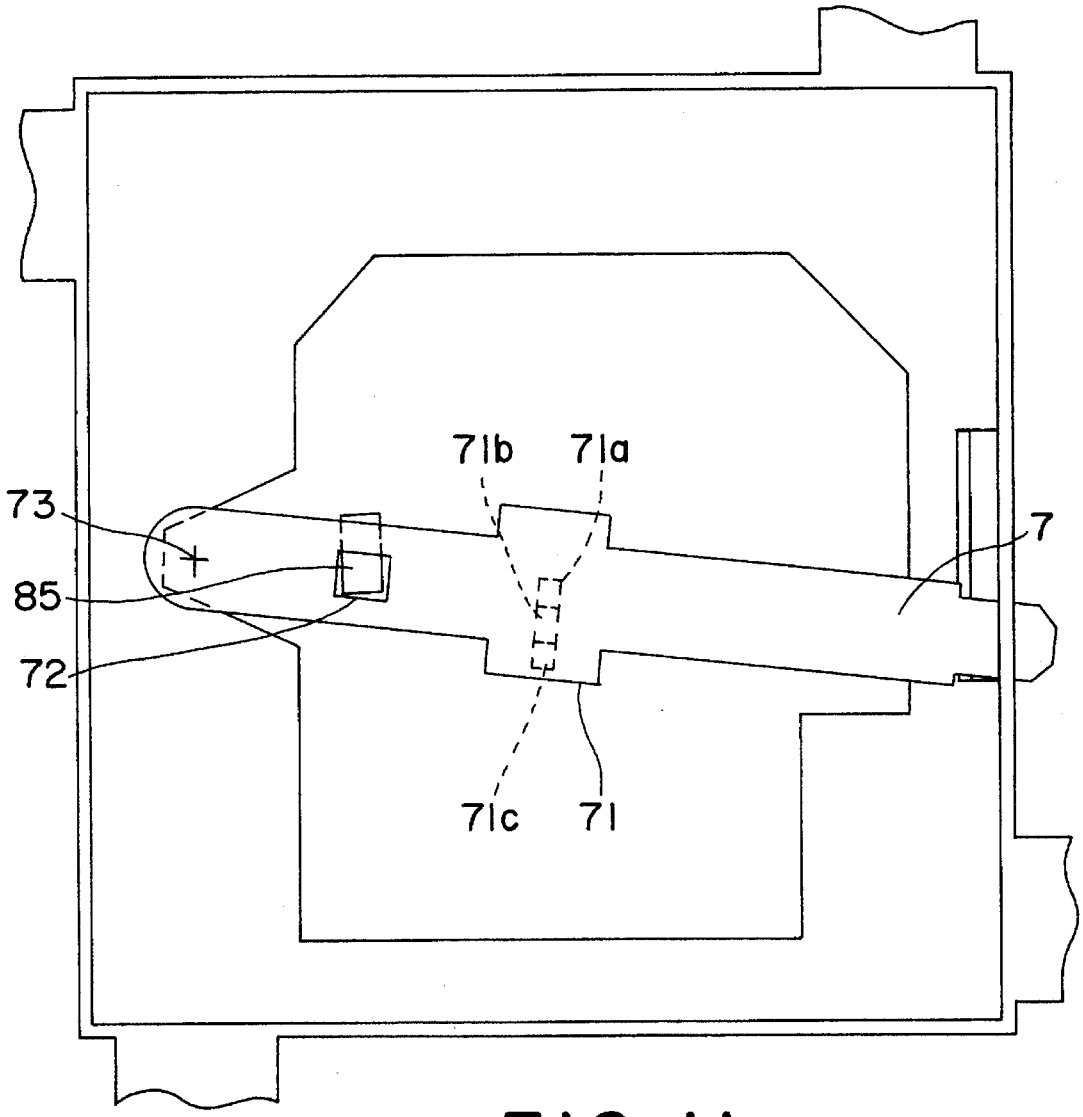
FIG. 11 shows the ON state of the switch from the bottom of the driving means housing.

FIG. 10 and FIG. 11 show the base of the housing 6. The mechanism of the switch 7 as a release means will be explained while referring to FIG. 10 and FIG. 11.

One end of switch 7 is supported at a fulcrum 73 and is a plate with a square 71 over the center and a hole 72 that cuts into square between the fulcrum 73 and the square 71. It can freely spin between the OFF position in FIG. 10 and the ON position in FIG. 11. Furthermore, a concave part 71*a* is set up on the top of the square 71. A protrusion 85 for switching the power switch of the motor 81 is inside the hole 72.

When the switch 7 is OFF, power to the motor 81 is cut by the protrusion 85 of the power switch of the motor 81 and the bottom end of the pin 9 is above a protrusion 71*c* at the top of the square 71 so that the game toy 1 is in a non-operating state.

When the switch 7 is turned to the ON position, electricity is applied to the motor 81 when the protrusion 85 of the power switch of the motor 81 moves and the concave part 71*a* of the square 71 of the switch 7 moves to below the pin 9. As a result, the pin 9 slides over a incline 71*b* and falls to release suspension of the arm 3. Thus, the support 51 begins to rotate. However, since suspension of the arm 3 in a vertical state has been released, the arm 3 begins to fall in a horizontal direction from this vertical state, as shown in FIG. 12(*a*). Moreover, as shown in FIG. 12(*b*), when the arm 3 falls to the horizontal position, a protrusion 40 in the bearing 39 touches the stopper 53 and the arm 3 is supported in the horizontal position and thereby rotates horizontally with the support 51.

When suspension is released as described above, the motor 81 begins to operate and rotation of the tower 5 starts. This turning force is applied to the arm 3. The arm 3, in a vertical state, falls horizontally when the turning force is applied. It is difficult to estimate the direction in which the arm 3 will fall when the game is started. Therefore, there is no advantage or disadvantade when the game is started and a game can be played fairly.

Furthermore, in this embodiment, a game is played in which players compete over the number of coins they can keep. However, the game can be finished when one of the players loses a coin. Moreover, a game time can be predetermined and appropriate rules can be established.

By this invention, players can compete over the number of pieces held by avoiding loss of pieces and therefore, obtain an amusement that is not given by a game for points simply imitating actual contests.

We claim:

1. A game toy which is characterized by comprising:

a piece retaining means for holding a player's piece at a desired position;

a moving object for moving said piece from said position by colliding with said piece;

a collision prevention means for avoiding collision of said moving object with said piece by operation of a player when said moving object is close to said piece;

a support means for supporting said moving object so that it can freely spin in a vertical direction; and a drive means for rotating said support means around a vertical axis.

2. The game toy according to claim 1, which is characterized by comprising a stopper means for stopping said moving object so that it is held in a vertical state and a release means with which said player can release said stopper means.

3. The game toy according to claim 2, which is characterized in that said stopper means comprises a movable pin which has an end engage with a concave section or hole in said moving object in order to stop said moving object.

4. The game toy according to one of claims 1 to 3, which is characterized in that said moving object has a colliding part which collides with said piece at a front end and a spindle at a back end of said moving object, with said moving object being supported so that it can freely spin around a fulcrum near said back end.

5. The game toy according to claim 1, which is characterized by that said collision prevention means has a lever supported so that it can spin freely up and down and a spring at one end of said lever attached so that it can spin freely at a predetermined angle with regard to a direction in which said moving object is moving, and said collision prevention means is made so that said moving object jumps due to a force of said spring when said player pushes other end of said lever.

* * * * *